US005194903A

United States Patent [19]

Negishi et al.

[11] Patent Number: 5,194,903

[45] Date of Patent: Mar. 16, 1993

[54] ELECTROPHOTOGRAPHIC PRINTER FOR A CONTINUOUS RECORDING FORM

[75] Inventors: Kiyoshi Negishi; Yoshimi Saito, both of Tsurugashima, Japan

[73] Assignee: Asahi Kogaku Kogyo Kabushiki Kaisha, Tokyo, Japan

[21] Appl. No.: 770,449

[22] Filed: Oct. 3, 1991

[30] Foreign Application Priority Data

Oct. 3, 1990 [JP] Japan ..... 2-265979

[51] Int. Cl.[5] ..... G03G 15/00

[52] U.S. Cl. ..... 355/316; 355/311; 226/24; 226/28

[58] Field of Search ..... 355/316, 317, 309, 311; 346/153.1, 160; 226/24, 27, 28

[56] References Cited

U.S. PATENT DOCUMENTS

| | | | |
|---|---|---|---|
| 4,377,333 | 3/1983 | Tsuji et al. . | |
| 4,843,429 | 6/1989 | Avritt et al. | 355/274 |
| 4,870,434 | 9/1989 | Negishi et al. | 346/160 |
| 4,890,140 | 12/1989 | Negoro et al. | 355/290 |
| 4,897,675 | 1/1990 | Negishi | 346/160 X |
| 4,912,490 | 3/1990 | Negoro et al. | 346/160 |
| 4,949,104 | 8/1990 | Negoro et al. | 355/316 X |
| 5,019,872 | 5/1991 | Zajac, Jr. . | |
| 5,023,667 | 6/1991 | Negoro et al. | 355/274 |
| 5,061,957 | 10/1991 | Nishikawa et al. | 355/200 |
| 5,063,416 | 11/1991 | Honda et al. . | |

*Primary Examiner*—Richard L. Moses
*Attorney, Agent, or Firm*—Sandler, Greenblum & Bernstein

[57] ABSTRACT

An electrophotographic printer using a plurality of types of continuous recording forms having different page lengths, respectively, with perforations being provided between pages of each of the continuous forms. The printer is operated at least in a standby state and in a printing state. The printer comprises feed means for feeding the continuous-form recording sheet loaded into the printer, and control means for controlling the feed means in such a fashion that the perforations is located at a predetermined position when the printer is in the standby state, regardless of the page length of the recording form loaded into the printer. The predetermined position coincides either with an image-transfer position or an image-fixing position.

10 Claims, 18 Drawing Sheets

ELECTROPHOTOGRAPHIC PRINTER FOR A CONTINUOUS RECORDING FORM

BACKGROUND OF THE INVENTION

The present invention relates to a printer for printing an image on a recording form by means of a so-called electrophotographic process.

A conventionally known electrophotographic imaging process is employed in a copying machine and so on, wherein the uniformly charged surface of a photoconductive drum is exposed to light which is reflected by or projected through an original image, to form a latent image thereon, toner is then adhered to the latent image to develop a visible image, and the developed toner image is transferred onto a recording form and fixed thereto by a fixing member.

Recently, a laser printer has been developed for printing an image on a recording form by means of an electrophotographic process wherein the circumferential surface of the photoconductive drum is scanned by a laser beam carrying optical image information, page by page, to form a corresponding latent image thereon.

In this laser beam printer, so-called cut-sheet recording forms which are cut into predetermined-size pieces are usually employed, and a so-called heat-fixing-roller pair is used to fix the toner image transferred onto the recording form. The heat-fixing-roller pair comprises a heat roller heated to a high temperature and a backup roller pressed against the heat roller, between which the cut-sheet recording form carrying a toner image passes so that the toner image is fused onto the recording form.

The above laser printer can of course be employed as a data output device of a computer, for which however it is preferable to use a continuous recording form as being done in a conventional line printer. The continuous recording form being generally used in the line printer is a so-called fan-fold sheet provided with a plurality of laterally arranged perforations where it can be folded and/or severed page by page.

For using this continuous recording form in the above laser printer, it becomes necessary to arrange a distance between an image-transfer point and an image-fixing point in the laser printer to substantially equal to the interval between the perforations of the continuous recording form, in order to prevent that transportation of the continuous recording form carrying the toner image from being stopped with remaining unfixed toner image portion between the heat-fixing-roller pair.

That is, since the image-printed continuous form is usually severed into pages after being discharged from the printer, the image must not be printed around the respective perforations. So, by arranging the distance between the image-transfer point and the image-fixing point to be substantially equal to the interval of the perforations, and by operating to stop the transportation of the continuous form at the time when the transferring of the toner image for the last page is completed, the vicinity of the respective perforations where no image is printed is placed at the image-fixing point, which prevents the above defect.

However, in case arranging as above, the printer becomes large-sized as a whole to ensure the necessary distance between the image-transfer point and the image-fixing point. Further, the printer as above arranged cannot employ various continuous recording forms with different perforation-intervals.

SUMMARY OF THE INVENTION

It is therefore an object of the present invention to provide an improved electrophotographic printer using a continuous recording form capable of arranging the distance between the image-transfer position and the image-fixing position without being regulated by the perforations-intervals of the continuous recording form, as well as capable of employing various continuous recording forms with different perforations-intervals.

For the above purposes, according to the present invention, there is provided an electrophotographic printer using a plurality of types of continuous recording forms having different page lengths, respectively, with perforations being provided between pages of the continuous recording forms. A toner image is transferred onto the continuous recording form at a transfer position and fixed at a fixing position. The printer is operated at least in a standby state and in a printing state, and comprises:

feed means for feeding the continuous recording form loaded into the printer; and control means for controlling the feed means in such a fashion that the perforations of the loaded continuous recording form are located at a predetermined position when the printer is in the standby state regardless of the page length of the continuous recording form loaded into the printer.

According to one aspect of the present invention, the predetermined position coincides with the transfer position of the printer.

According to another aspect of the present invention, the predetermined position coincides with the fixing position of the printer.

The above and other objects, features and advantages of the present invention will become apparent from the following detailed description which is to be read in conjunction with the accompanying drawings.

DESCRIPTION OF THE ACCOMPANYING DRAWINGS

FIG. 3A–3G, 4A–4G, 5A–5G, and 6A–6G are diagrams explaining the various states of the laser beam printer as a continuous recording form is fed in the laser beam printer; and FIGS. 7A–7B, 8, and 9A–9B are control flowcharts executed by the laser beam printer.

DESCRIPTION OF THE EMBODIMENTS

Hereinafter, embodiments of the present invention will be described with reference to the drawings.

Figure 1:
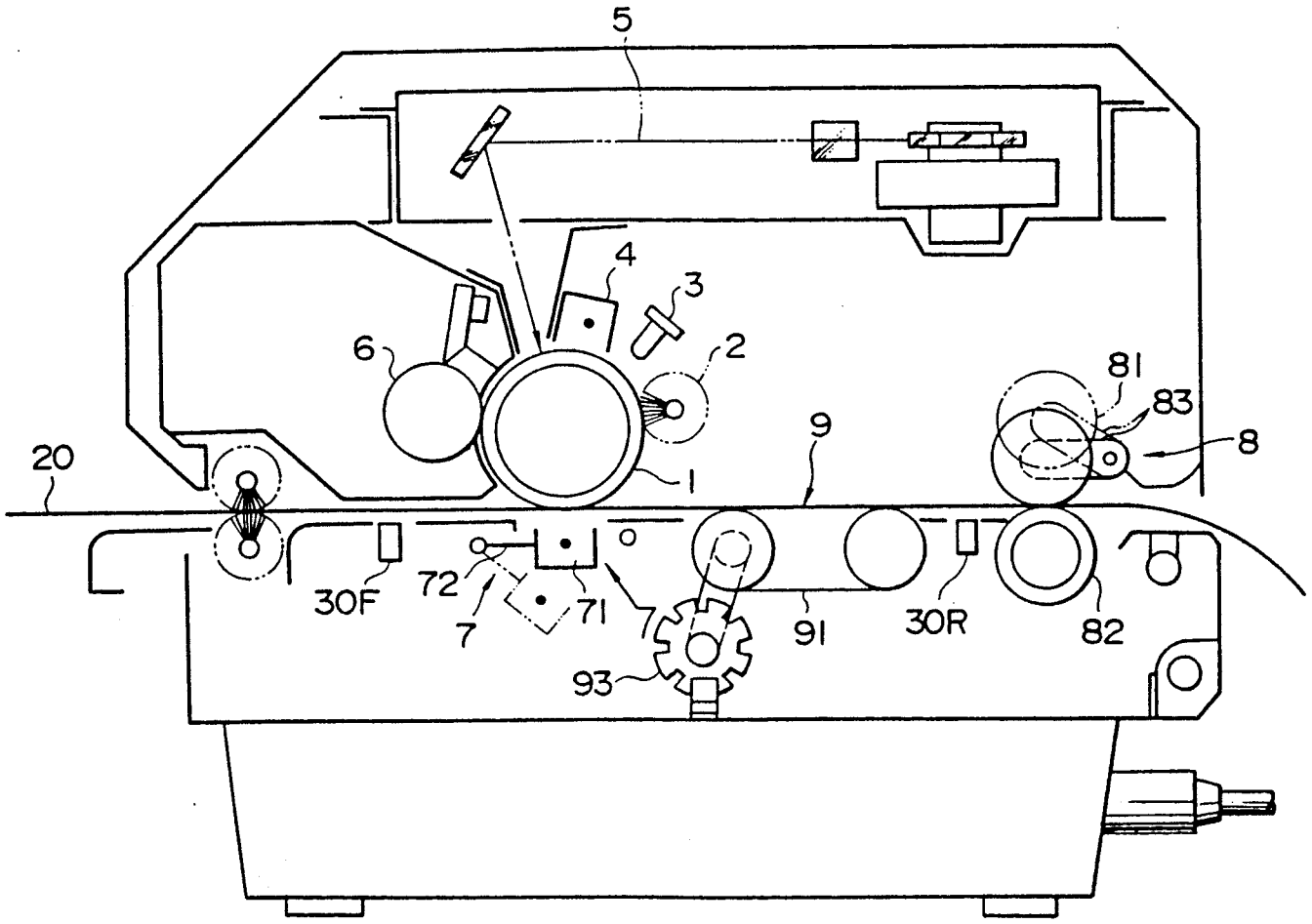
FIG. 1 is a side view showing the schematic arrangement of a laser beam printer embodying the present invention.

FIG. 1 shows a laser beam printer embodying the present invention, which is prepared to be employed as a data output device of a computer for printing outputted data on a continuous form 20 which passes through inside the printer on a predetermined transportation path.

In the illustrated laser beam printer, a photoconductive drum 1 is rotated by a main motor, not shown, at a predetermined circumferential speed, and a toner cleaner 2, a discharging unit 3, a charging unit 4, a scanning optical system 5, a developing unit 6 and a transfer unit 7 are disposed around the periphery of the drum 1 in due order along the rotating direction thereof.

Downstream of the drum 1 along the transportation path, arranged are a tractor unit 9 for transporting the continuous form 20, and a fixing unit 8. Further, sensors 30F and 30R are disposed upstream of the drum 1 and upstream of the fixing unit 8, respectively.

In the laser beam printer constituted as described above, the uniformly charged surface of the photoconductive drum 1 is repeatedly scanned in its axial direction by laser beams emitted from the scanning optical system 5 (main-scanning) while the drum 1 is rotating in the counter-clockwise direction in FIG. 1 (auxiliary-scanning) to form a latent image on the surface thereof. The latent image is then developed into a toner image at the developing unit 6, which is transferred at the transfer unit 7 onto the continuous form 20 transported by the tractor unit 9 along the transportation path, and fixed thereonto by the fixing unit 8 before being discharged outside of the printer.

The tractor unit 9 comprises a pair of endless belts 91 associated to each other and disposed in parallel along the transportation path. Each of the endless belts 91 is provided with pin-shaped projections to be engaged with sprocket holes defined on each side edge of the continuous form 20. One of pulleys which associate the pair of endless belts 91 is coupled to a motor, not shown, and driven thereby in the transporting direction of the continuous form 20.

Further, an encoder 93 is coupled to the tractor unit 9 and synchronously operated therewith, so that the transporting speed of the continuous form 20 can be directly detected from pulse signals generated by the encoder 93.

The encoder 93 comprises a disk having slits defined at equal intervals along the circumferential periphery thereof, and a photo-interruptor receiving partly the circumferential periphery of the disk. Thus, as the disk rotates upon circulation of the endless belts 91, the photo-interruptor detects the passing of the respective slits to output a pulse by every passing, in synchronism with circulation of the endless belts 91, i.e., with transportation of the continuous form 20.

The transfer unit 7 comprises a corona charger 71 having a length substantially similar to the axial length of the photoconductive drum 1 and supported by a swingable arm member 72 with a predetermined interval from the drum 1. The corona charger 71 is retracted to a position illustrated by a dash line in FIG. 1 when the transfer operation is not carried out.

The fixing unit 8 comprises a pair of rollers consisting of a heat roller 81 and a backup roller 82 that are arranged to be pressed to each other. The upper heat roller 81 includes therein a heating element such as a halogen lamp or the like to be heated to a predetermined temperature, and is supported by a swingable lever 83 so as to be retracted to a position illustrated by a dashed line in FIG. 1 when fixing operation is not carried out, thus spaced apart from the continuous form 20. In addition, the heat roller 81 is driven by a motor, not shown, to be rotated at a circumferential speed substantially similar to the transporting speed of the continuous form 20.

Figure 2:
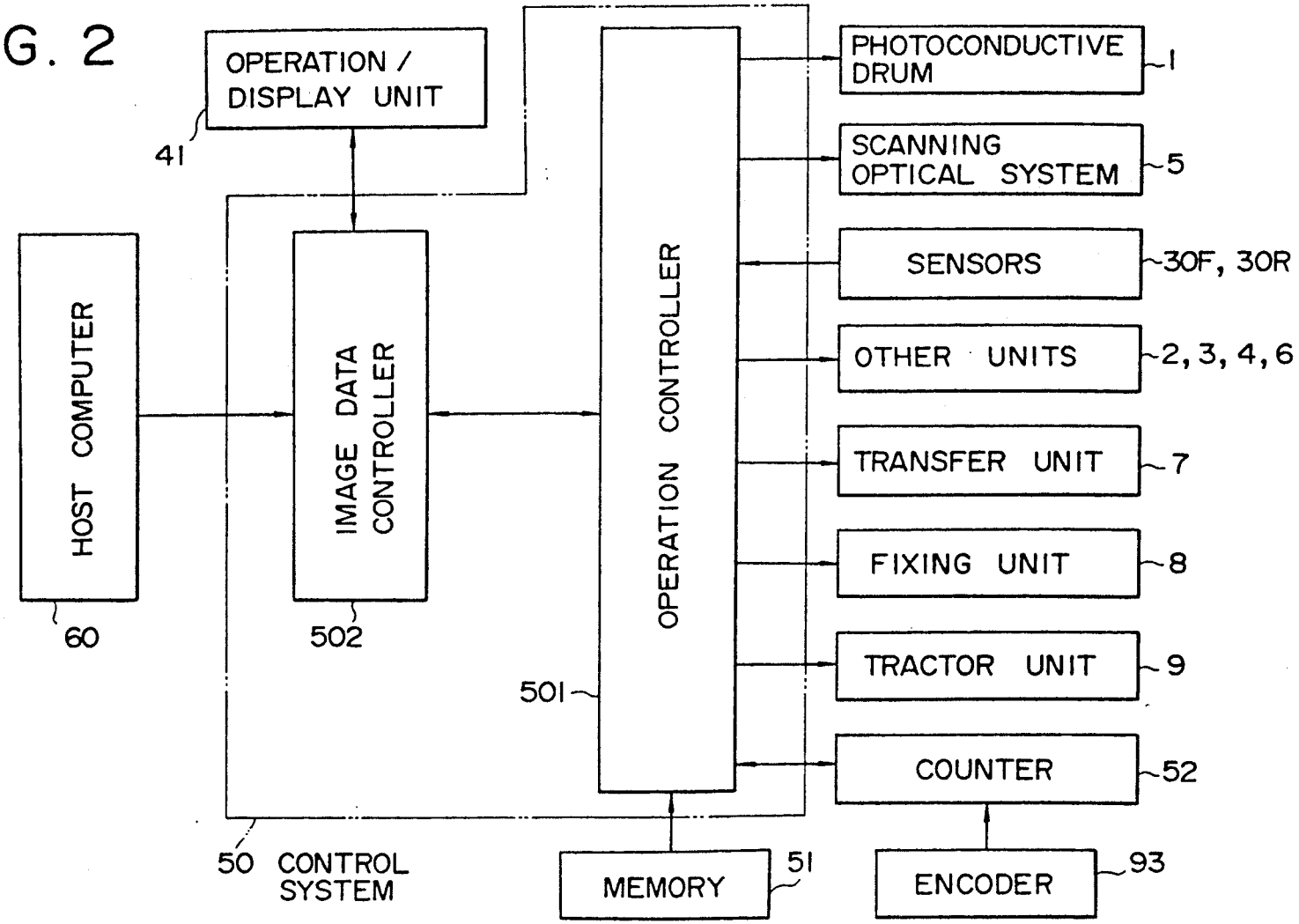
FIG. 2 is a block diagram of the laser beam printer of FIG. 1.

FIG. 2 is a block diagram showing an electronic control system 50 of the laser beam printer of FIG. 1, which principally comprises an operation controller 501 and an image data controller 502.

The operation controller 501 controls operations of respective component-parts of the printer for carrying out printings, and the image data controller 502 controls data transfer from a host computer 60.

The electronic control system 50 receives signals from the sensors 30F, 30R, data from a counter 52 which counts the number of pulses generated by the encoder 93, and operation data input through an operation/display unit 41 which usually comprises a console panel. The operation data includes information relating to the perforations-interval of the continuous form to be used, based upon which, corresponding control data, to be described later, is taken out of a data table stored in a memory 51. Then, the electronic control system 50 controls printing operations based on the control data to print the data transferred from the host computer 60 and saved in a page buffer, not shown, page by page.

Next, the operation carried out by the control system 50 will be described with reference to the flow-charts shown in FIGS. 7 and 8.

The operation mainly comprises two operations: a top-set operation for setting the continuous form 20 to a predetermined state prior to a printing operation; and a printing operation.

In the operation, the state of the continuous form 20 is first judged based on a signal detected by the sensor 30F (step S1). Note, at this time the corona charger 71 of the transfer unit 7 and the heat roller 81 of the fixing unit 8 are retracted.

When the sensor 30F is "OFF", i.e., when the presence of the continuous form 20 is not detected, the operation/display unit 41 displays "No Paper" to request the setting of the continuous form 20 (step S1-1).

Figure 3A:
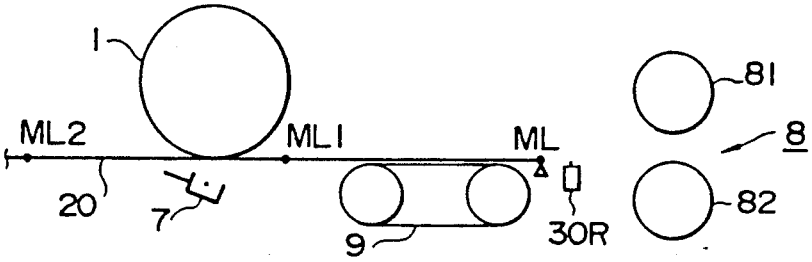

When the sensor 30F is "ON", it can be said that the continuous form 20 is at least under the state illustrated in FIG. 3A which shows the initial-set state of the continuous form 20. Then, the control data corresponding to the continuous form 20 now being set, is read out from the memory 51 and saved in the operation controller 501 (step S2). The control date includes:

T1: a time from the start of a scanning/exposure operation carried out on the surface of the drum 1 to the start of the transportation of the continuous form 20;

N: the number of pulses to be generated by the encoder 93 corresponding to a time from the start of the synchronized operations of the transportation and the scanning/exposure to the start of the image-transfer operation at the transfer unit 7;

L: the number of pulses to be generated by the encoder 93 corresponding to a time from the end of the image-transfer operation to the completion of the transportation of the perforations of the last image-transferred page of the continuous form 20 to the fixing unit 8; and

M: the number of pulses to be generated by the encoder 93 corresponding to a time required for transporting the continuous form 20 for a distance obtained by adding the length of one page to the distance from the sensor 30R to the fixing unit 8.

The relationship between these constants and the control carried out in the laser beam printer will be described later.

Although a ROM can be used as the memory 51 for storing the above data-table, other memory means such as a cartridge type memory, a PROM and an EPROM can be used as well.

Then, it is checked whether the sensor 30R is "ON", i.e., whether printing is carried out on the continuous form 20 already under use (step S2-1). When the sensor 30R is "OFF", the continuous form 20 is under its initial-set state illustrated in FIG. 3A so that the top set operation must be done prior to the printing operation.

Figure 3B:
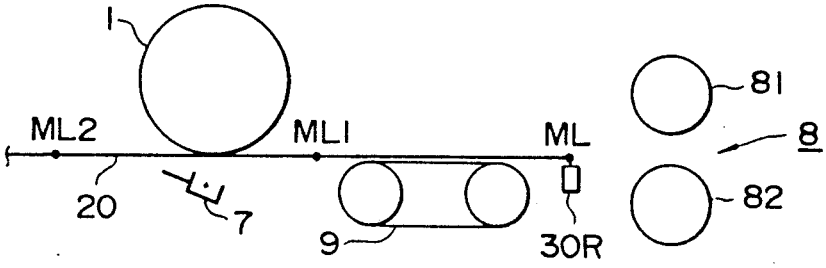
Figure 3C:
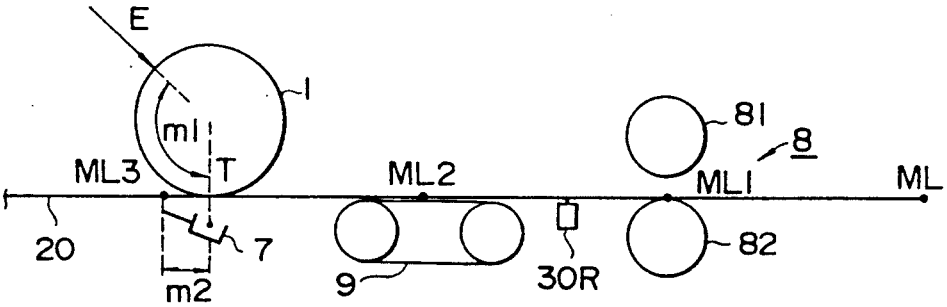
Figure 8:
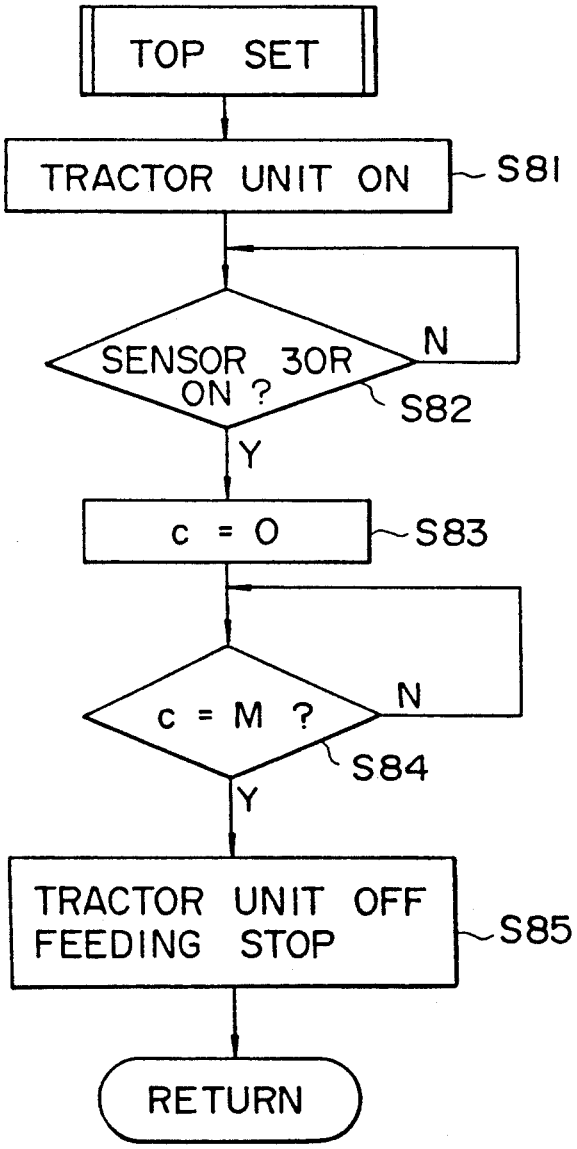

Top set operation is illustrated in FIG. 8 in detail, wherein the tractor unit 9 is driven to transport the continuous form 20 (step S81) until it reaches the state illustrated in FIG. 3C via the state illustrated in FIG. 3B. That is, when the leading end ML of the continuous form 20 passes through the sensor 30R (step S82), the counter 52 is reset (step S83) and the tractor unit 9 stops driving when the counter 52 counts M pulses generated by the encoder 93 (steps S84 and S85). At this stage, the rear end of the leading page of the continuous form 20 is located at the predetermined position relative to the fixing unit 8, as illustrated in FIG. 3C, which is a standby (print-waiting) state where preparation for printing has been completed. Thus, the top set is completed.

The number of pulses M, which should be generated before the continuous form 20 reaches the print-waiting position after the leading end ML thereof has been detected by the sensor 30R, is previously known based on the positional relationship between the sensor 30R and the fixing unit 8, so that the continuous form 20 can be correctly set to the above print-waiting state.

Note that MLn shown at equal intervals in FIGS. 3A to 3G show a boundary or a perforations of each page, wherein n is a positive integer.

Thereafter, when a printing is requested (step S2-2), the fixing unit 8 is brought to its ON state where the heat roller 81 is abutted against the backup roller 82 (step S3), thus the fixing unit 8 is prepared for fixing operation.

At step S4, it is checked whether T1 is positive to determine if either of the scanning/exposure operation and the transportation of the continuous form 20 should first be carried out, which is different depending upon the type of the continuous form 20 used. A distance m2, shown in FIG. 3C, between a transfer position T and a perforations under the top set state depends upon the kind of the continuous form 20, since an exposure start position E and therefore a distance m1 between the positions E and T are initially determined.

If the drum 1 is scanned/exposed and the continuous form 20 is fed simultaneously from the top set position, when $m1<m2$, an image is transferred from the right side of the perforations ML3 in FIG. 3C. Accordingly, in order to start the image-transfer from an appropriate position on the continuous form 20, a time lag must be provided between the start of the scanning/exposure on the drum 1 and the start of the transportation of the continuous form 20, based on the relationship between m1 m2.

Note, although the transfer start position is assumed to be coincident with the perforations for simplification in the following description, the image-transfer is started, in the practical operation, at a position spaced apart from the perforations by a predetermined distance. Further, in case that T1 is zero, the scanning/exposure on the drum 1 and the transportation of the continuous form 20 are started at the same timing. More specifically, steps S4-1 and S4-5 are almost simultaneously carried out. Note that the transportation of the continuous form 20 by the tractor unit 9 is carried out in synchronism with the rotation of the fixing unit 8.

Figure 3D:
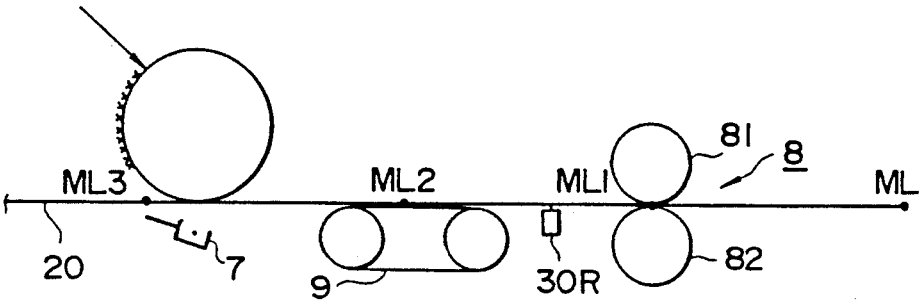
Figure 3E:
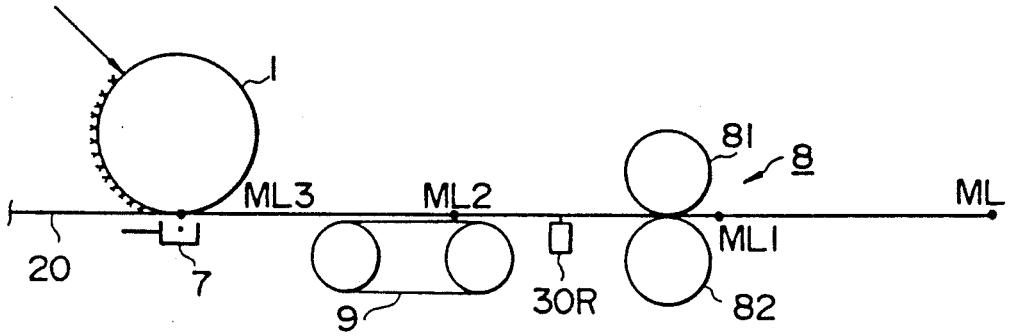
Figure 3F:
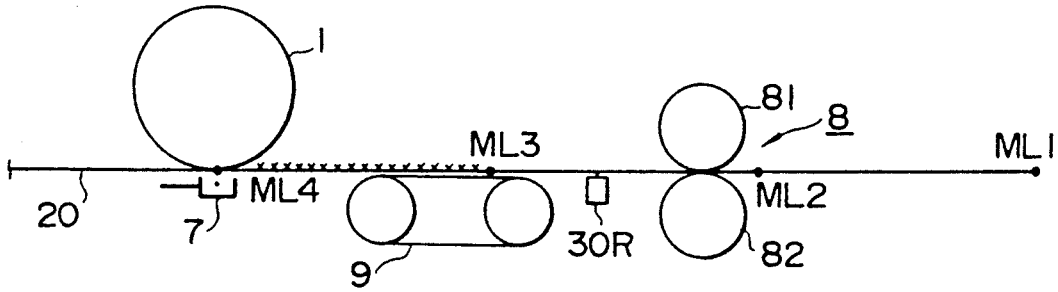

After both of the scanning/exposure on the drum 1 (step 4-1, step S9) and the transportation of the continuous form 20 (step S5 and step S4-5) have been started, the state of which is illustrated in FIG. 3D, the counter 52 counts the number of pulses generated by the encoder 93 (steps S10 and S12). When $C=N$ is detected at step S12, the image-transfer operation starts at step 13 and continues until one page exposure is completed (step S14), and then it is checked whether there is a subsequent pages to be continuously exposed (step S15). If Yes, scanning/exposure therefor is continued (step S15-1) as well as the image-transfer operation.

When there is no subsequent page to be exposed at step S15, time is checked until $t=Tf$ at steps S16 and S17, and the image-transfer operation is finished (step S18). Tf is a time required for rotation of the drum 1 from scanning/exposure position to the transfer position, i.e., from the state illustrated in FIG. 3E to the state illustrated in FIG. 3F.

Figure 3G:
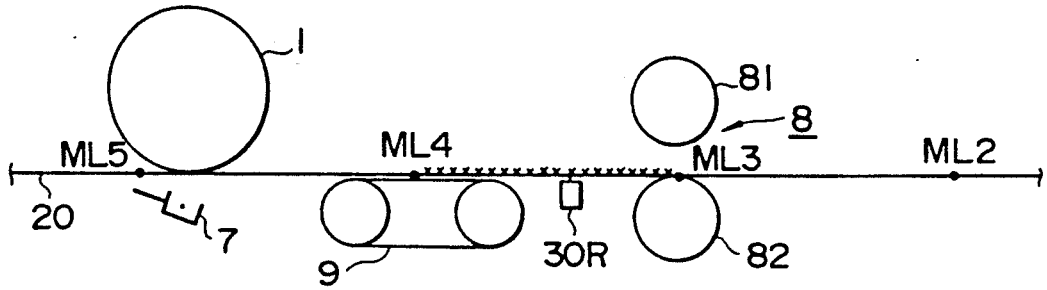

Even after the transfer unit 8 is turned OFF at step S18, the transportation of the continuous form 20 continues until the counter 52 counts L (steps S19 and S21), the state at the time of which is as illustrated in FIG. 3G where the front perforations of the last image-printed page has reached the fixing unit 8. Once the counter counts L pulses, both the tractor unit 9 and the fixing unit 8 are turned off (step S22).

At this stage, the positional relationship between the plurality of perforations of the continuous form 20 and the transfer and fixing units 7 and 8 becomes substantially same as that under the top set state illustrated in FIG. 3C. Thus, another printing can be executed by repeating the above processes without executing the top set operation.

Note, although a last image-printed remains in the printer in the above-described embodiment, it may of course be arranged to be fixed and discharged out of the printer by providing a compulsory paper discharge switch or may be discharged when a main power switch is turned OFF.

The above FIGS. 3A through 3G show the case in which the perforations-interval of the continuous form 20 is smaller than the distance between the transfer unit 7 and the fixing unit 8, whereas FIGS. 4A through 4G, which respectively correspond to FIGS. 3A through 3G, show the case in which the former is larger than the latter.

Figures 4A, 4B, 4C:
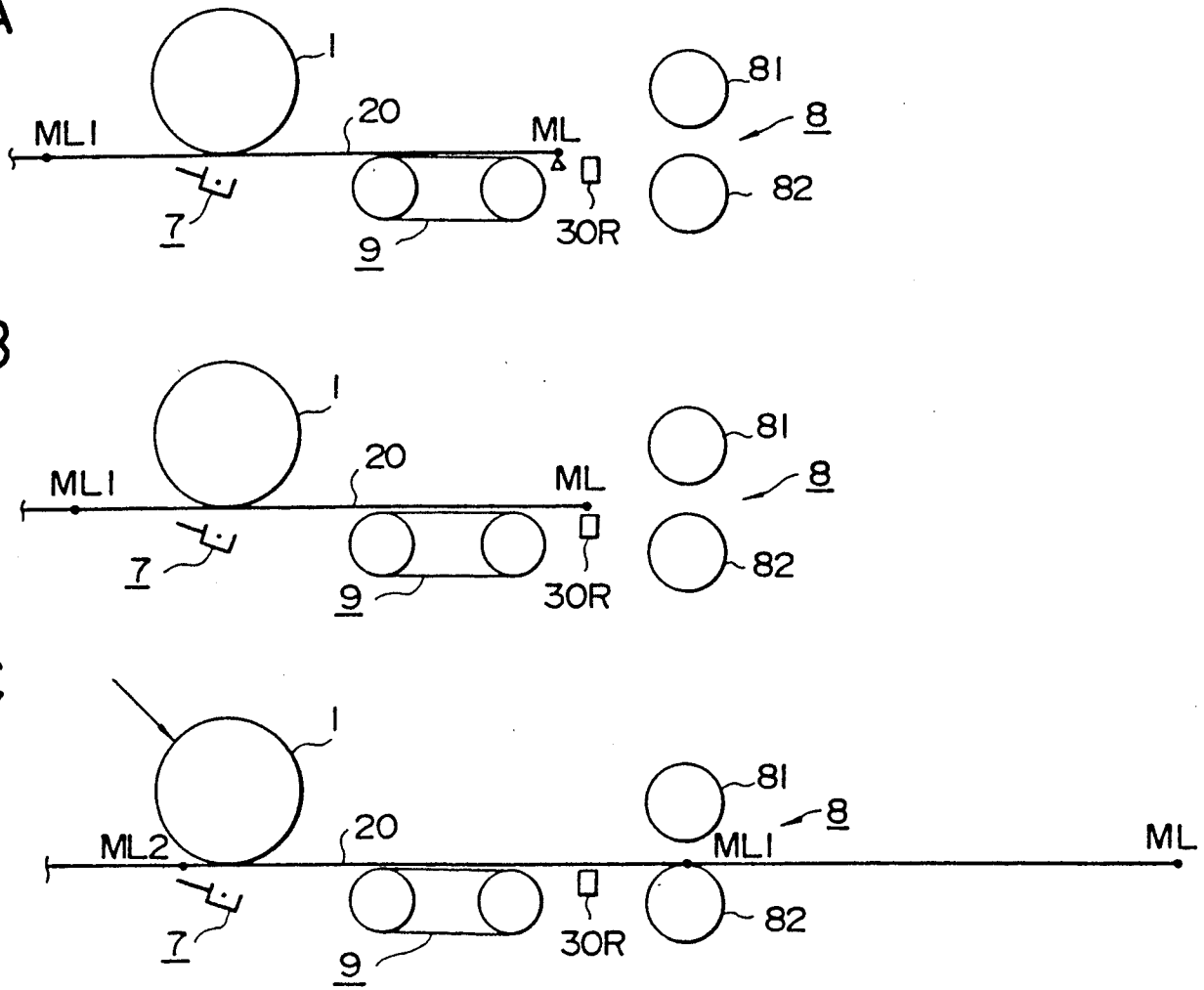
Figure 4D:
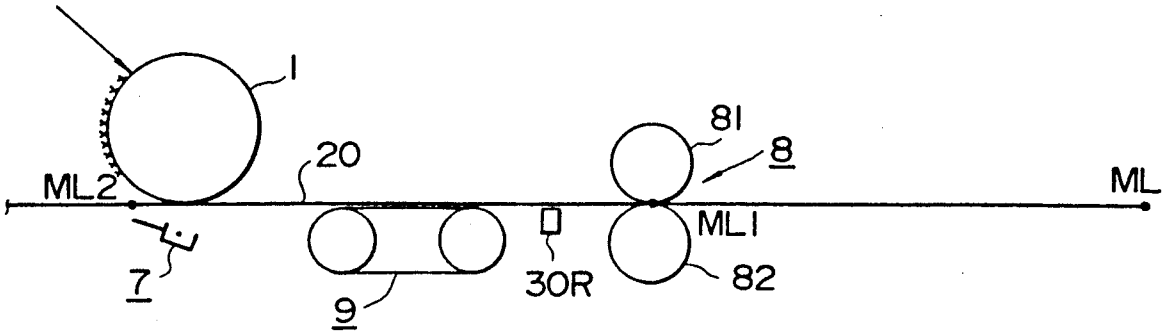
Figure 4E:
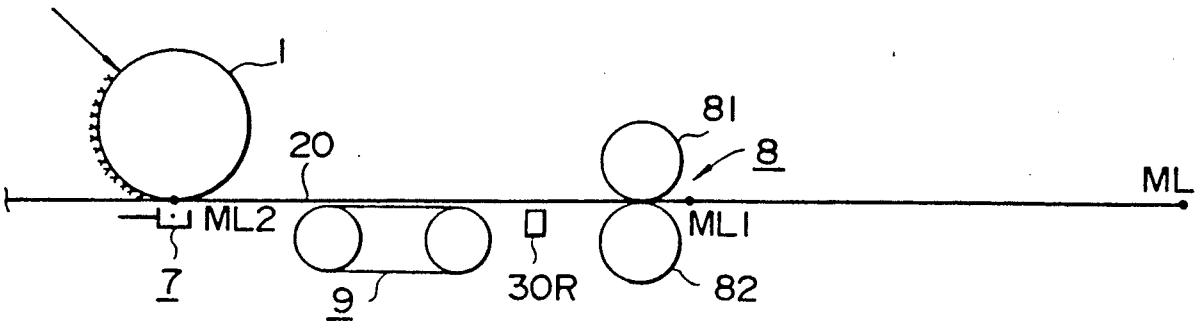
Figure 4F:
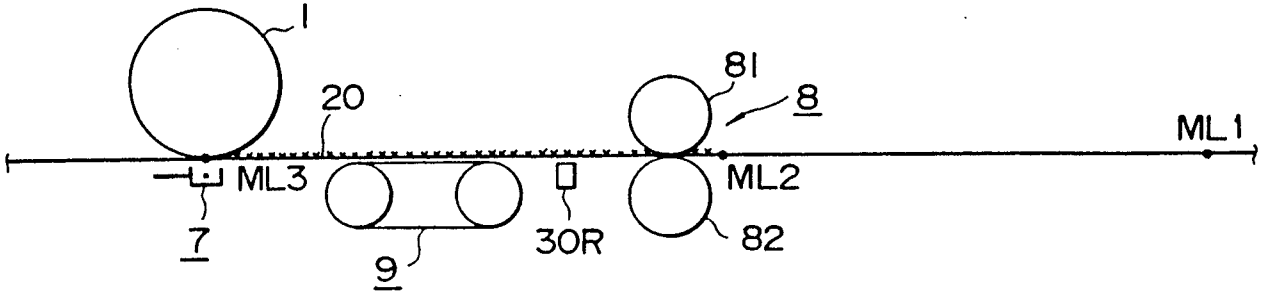
Figure 4G:
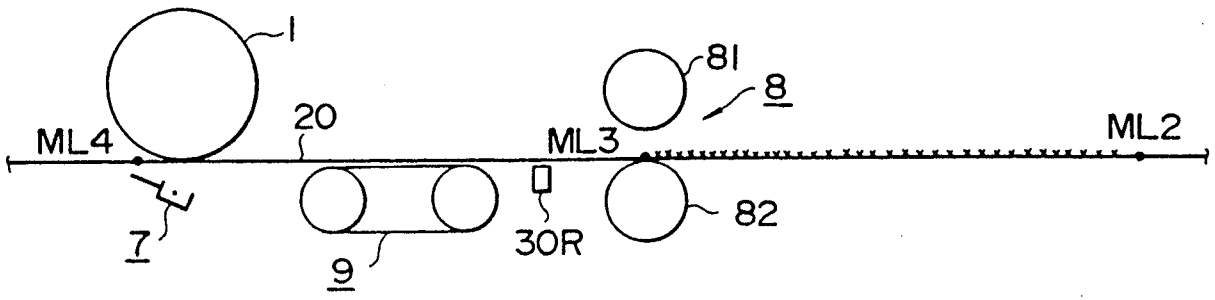
Figure 7A:
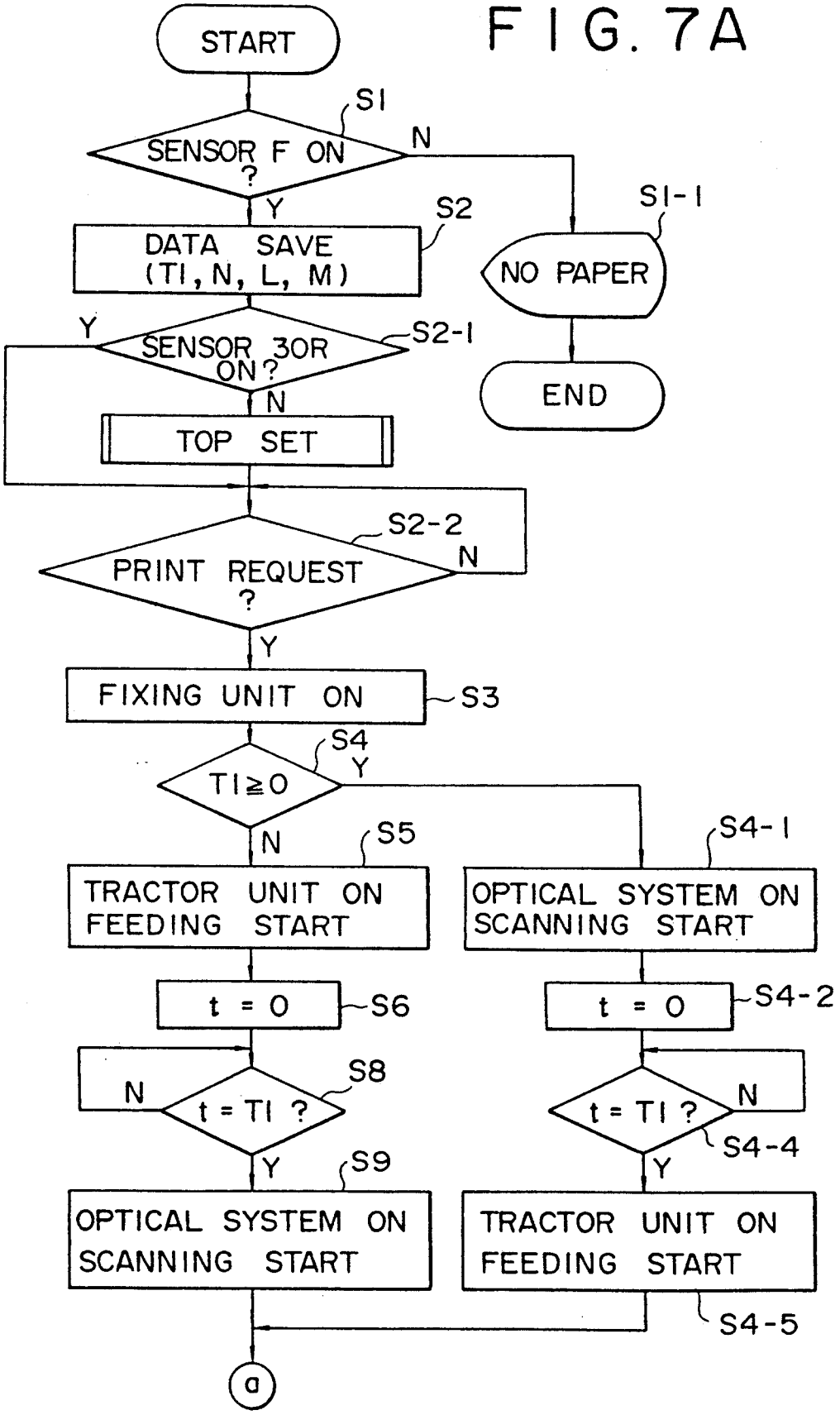
Figures 7, 7B:
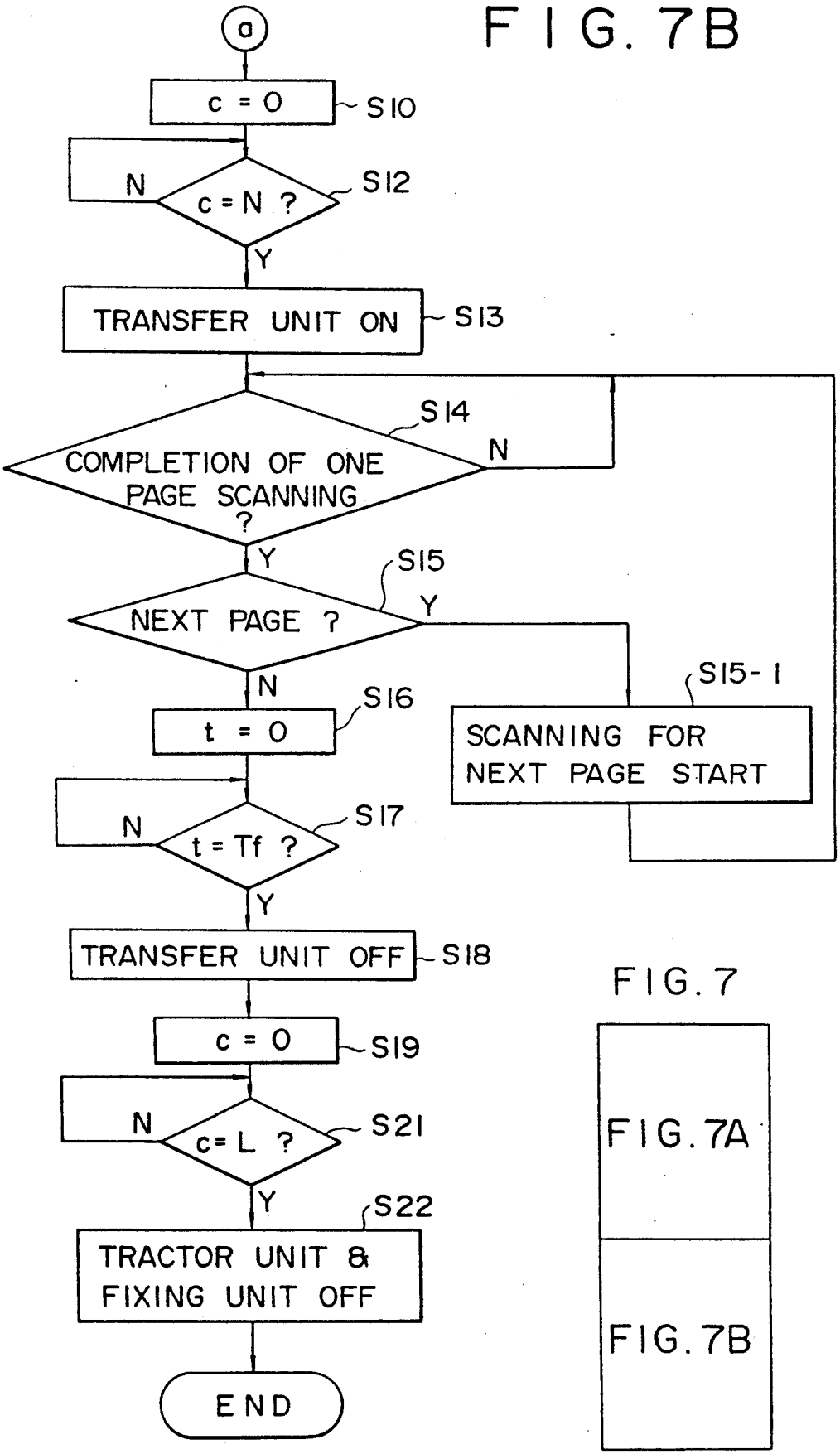

In this case, as shown in FIG. 4F, the front perforations of the last image-printed page has already passed through the fixing unit 8 upon the completion of the transfer operation, and when the continuous form 20 is fed from this stage until $C=L$ is achieved at step S21 in the flowchart of FIG. 7, the top set completion state is restored at the time that the fixing operation has been completed as shown in FIG. 4G.

Figure 9A:
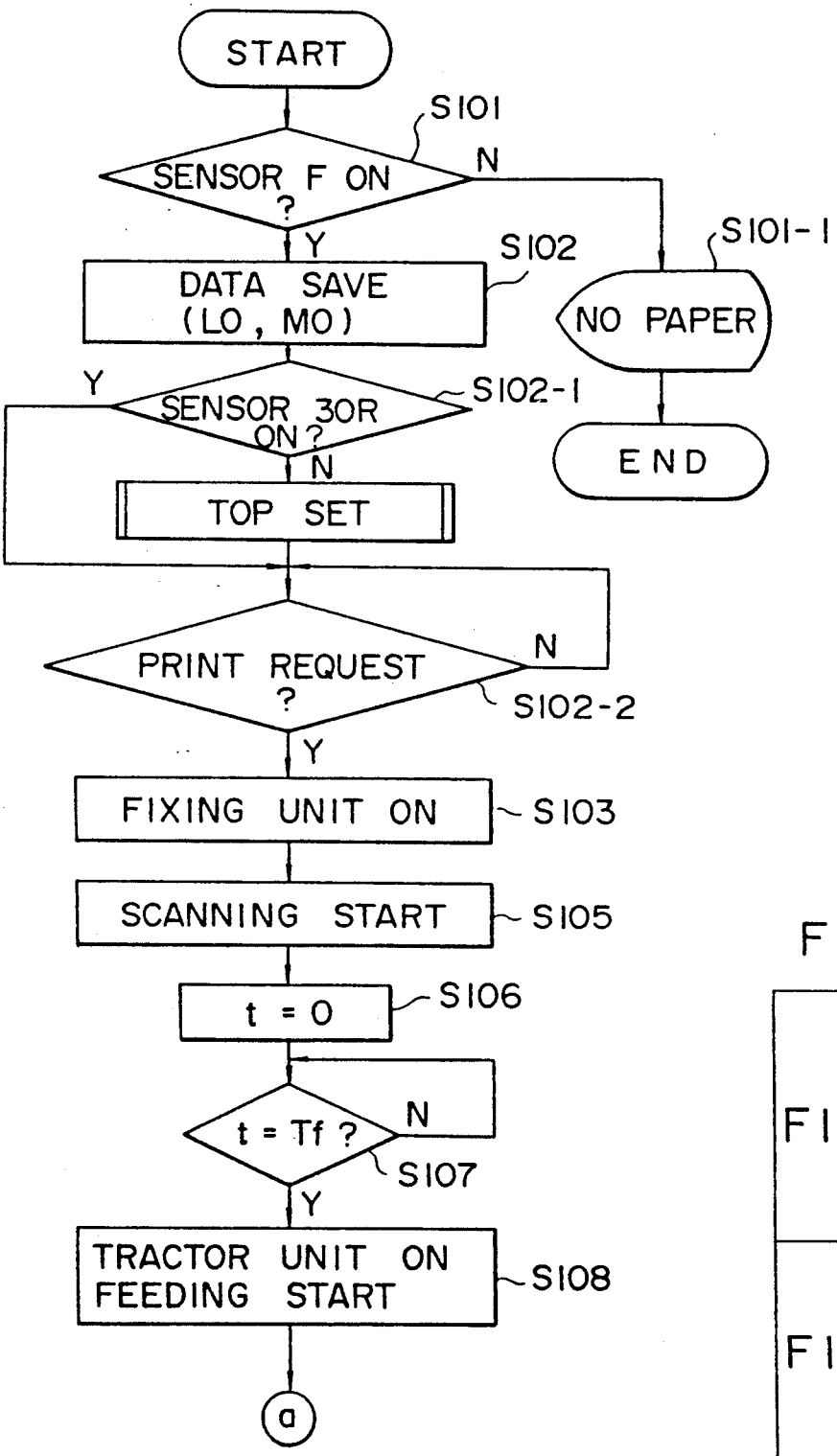
Figure 9:
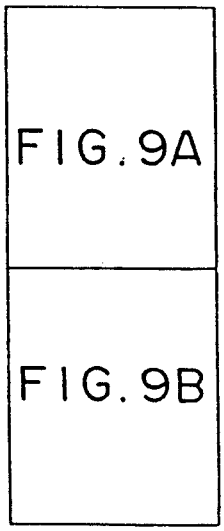
Figure 9B:
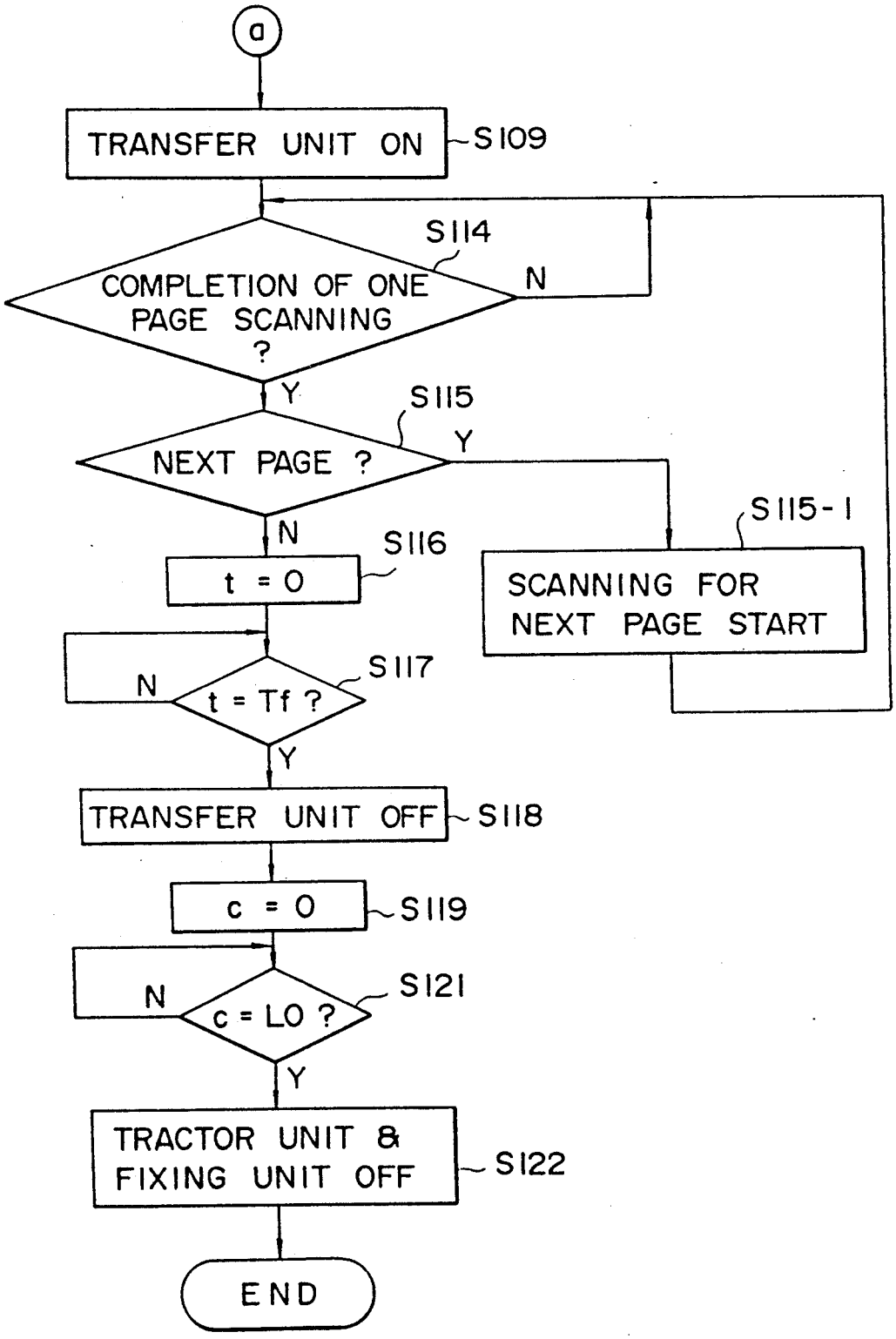

Next, a modified embodiment of the present invention will be described with reference to a flowchart of FIG. 9 and the diagrams shown in FIGS. 5A through 5G.

Although the previous embodiment sets the leading end of the continuous form 20 at the fixing unit 8 in the top set operation, in this modified embodiment, it is set at the image-transfer position of the transfer unit 7. Since this modified embodiment fundamentally operates in the same way as the above first embodiment, only the portion specific to this embodiment will be described.

In this modified embodiment, two kinds of data, i.e., L0 and M0, which correspond to L and M in the first embodiment, respectively, are read and saved at step S102. L0 is the number of pulses corresponding to the required transportation of the continuous form 20 after the image-transfer operation has been completed; and M0 is the number of pulses corresponding to the transportation of the continuous form 20 by the amount obtained by adding L0 at the time shown in FIG. 5B where the leading end of the continuous form 20 is detected by the sensor 30R, to the length of one page of the continuous form 20. Thus, this embodiment is advantageous in that the amount of data to be read is less than that in the above first embodiment.

Figure 5A:
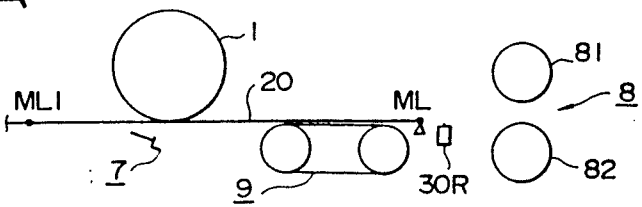
Figure 5B:
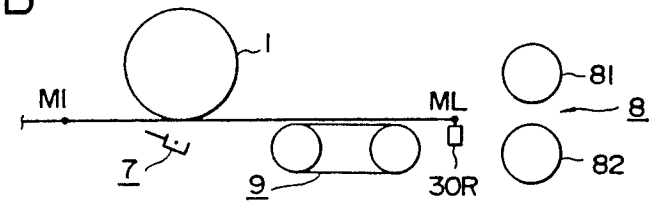
Figure 5C:
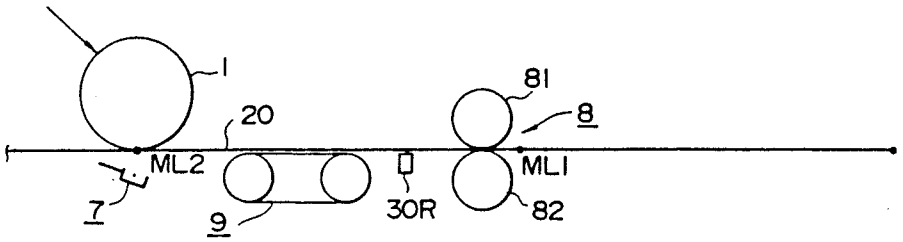
Figure 5D:
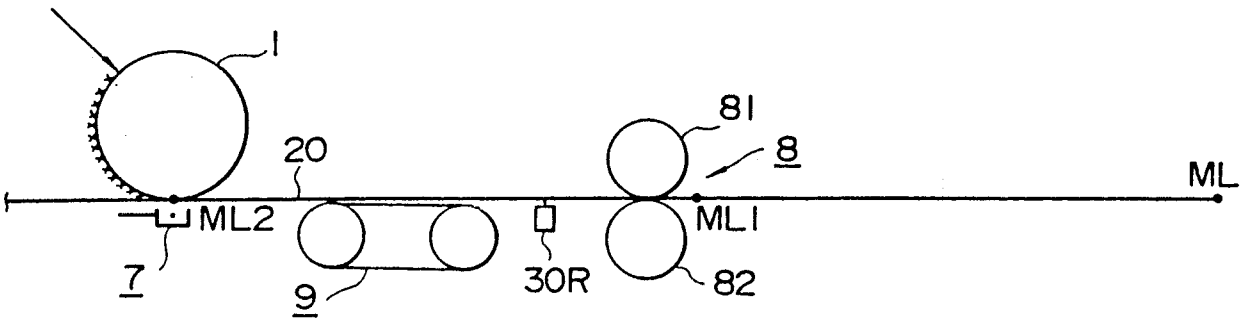
Figure 5E:
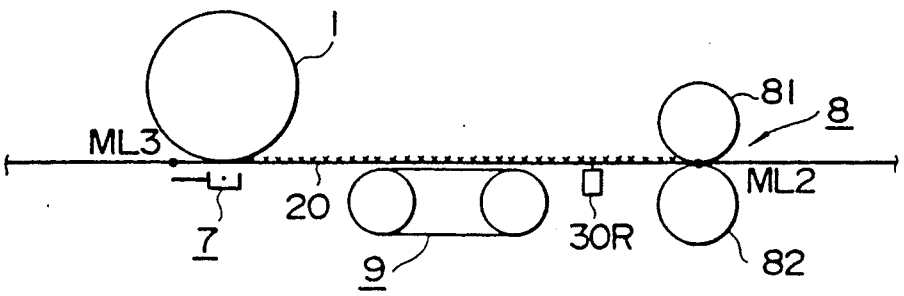
Figure 5F:
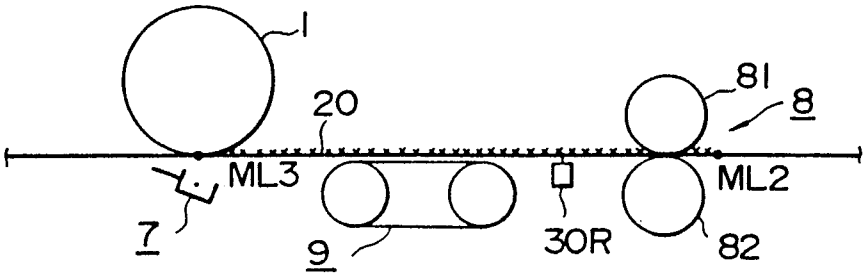
Figure 5G:
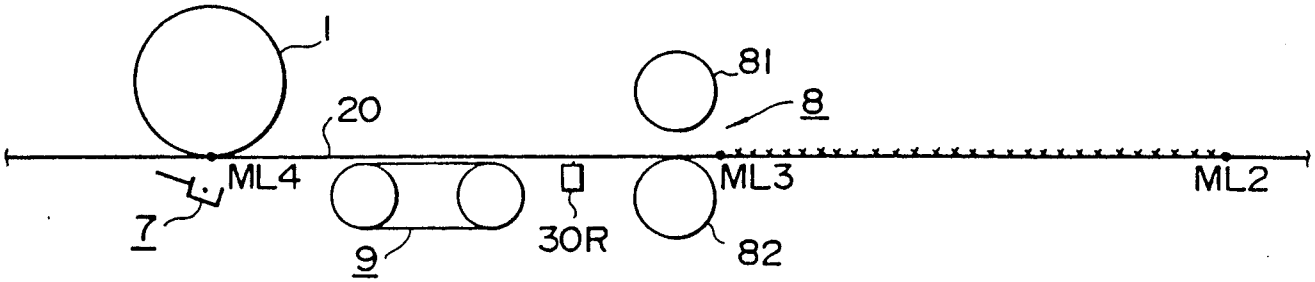
Figure 6A:
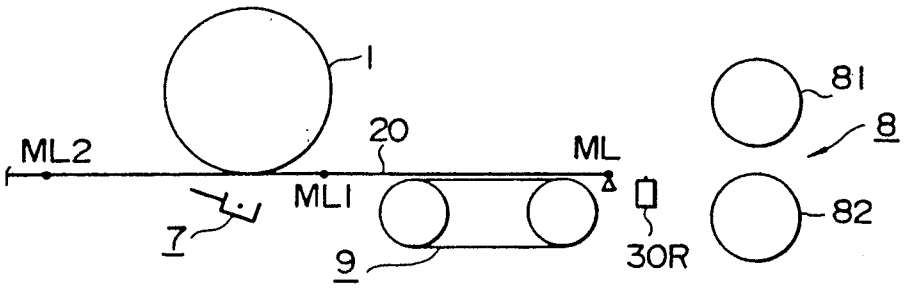
Figure 6B:
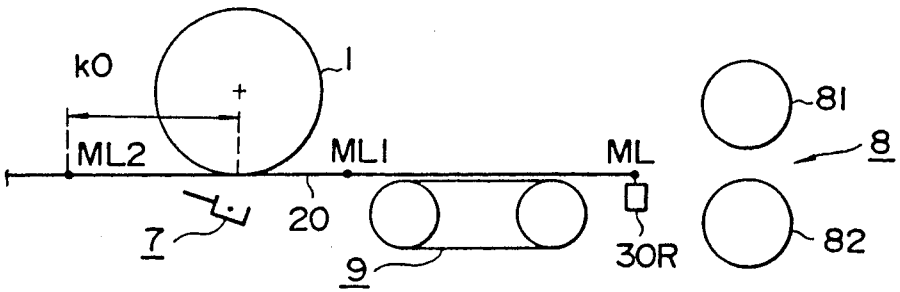
Figure 6C:
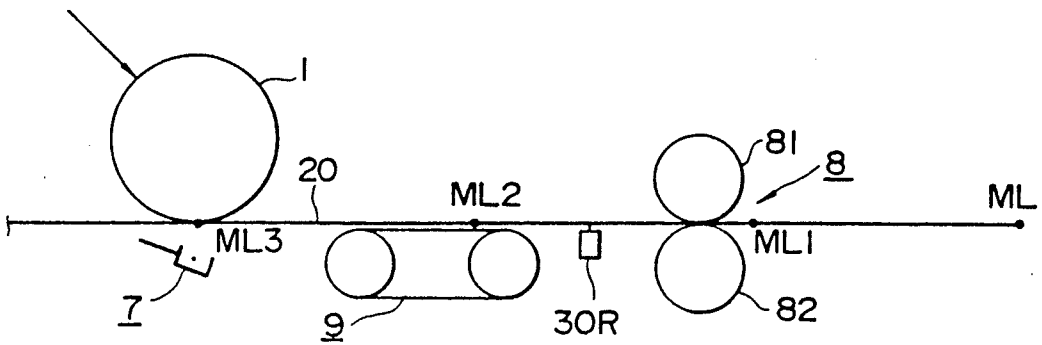
Figure 6D:
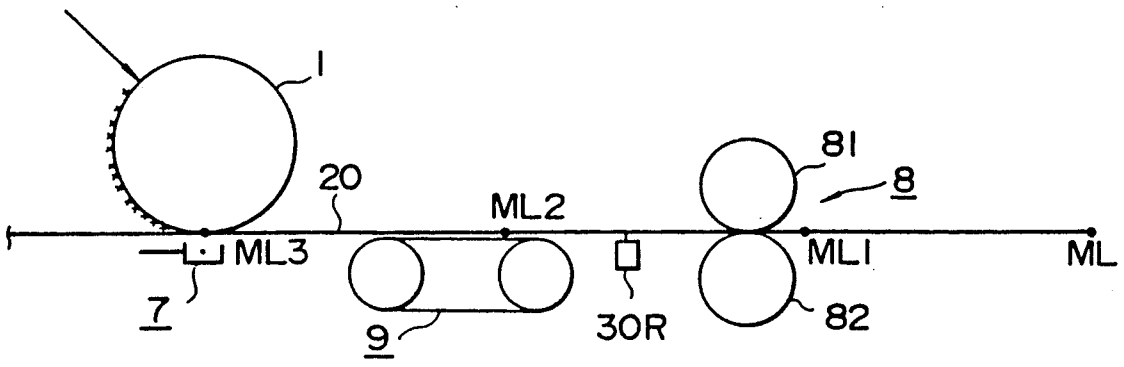
Figure 6E:
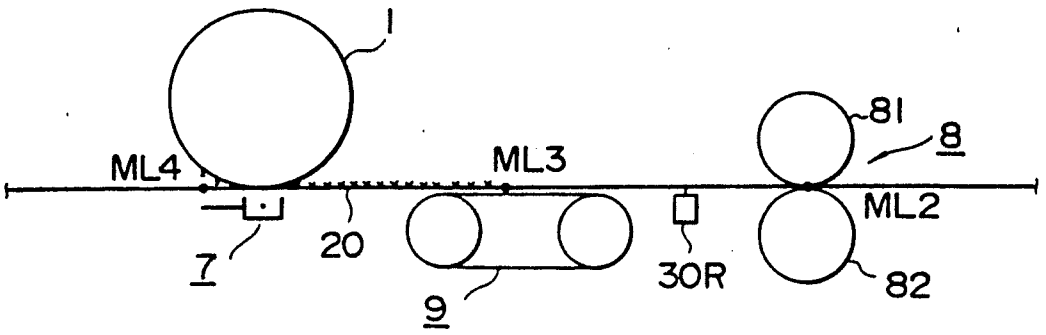
Figure 6F:
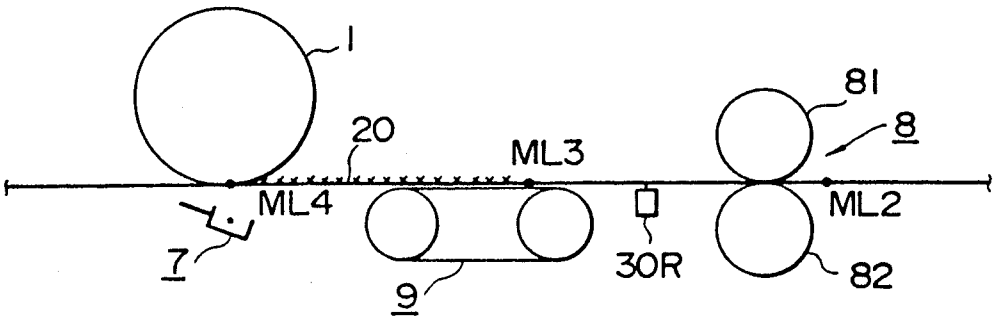
Figure 6G:
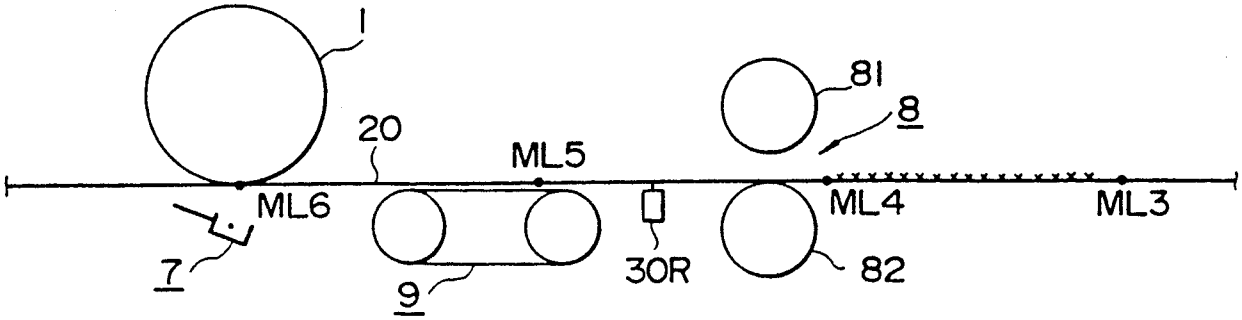

Further, in this embodiment, the continuous form 20 is transferred by the amount corresponding to M0 at steps S83 and S84 in the top set operation, i.e., the perforations is placed at the transfer position upon the completion of the top set, as illustrated in FIG. 5C. Accordingly, the selection which was done at step S4 and succeeding two way operations at steps S4-1 to S4-5 and steps S5 to S9 in the first embodiment (FIGS. 7A-7B), becomes unnecessary, even if continuous forms having different perforation-intervals are interchangeably employed.

In this embodiment, after the transfer operation has been completed at steps S117 and S118, the continuous form 20 is further transported by the amount corresponding to the above L0 (steps S119, S121, and S122). When the perforations-interval is smaller than the distance between the transfer unit 7 and the fixing unit 8, the above LO is stored in the table as the number of pulses corresponding to the amount required for transportation of two pages, for preventing transferred images from being only partially fixed.

FIGS. 6A through 6G show the case in which the perforations-interval is smaller than the distance between the transfer unit 7 and the fixing unit 8, and in this case, the number of pulses corresponding to the amount required for transportation of two pages is stored as the above L0. Therefore, all the pages on which an image has been printed passes through the fixing unit 8.

According to the electrophotographic printer described above, since the controller controls the transportation of the continuous form based on the control data which is preset in accordance with the length of one page thereof stored in the memory means, the distance between the photoconductive drum and the fixing unit can be set regardless of the length of one page of the continuous recording form, whereby the size of the printer can be reduced as a whole, and further the printer can employ various types of continuous recording forms with different perforations-intervals.

The present disclosure relates to subject matter contained in Japanese patent application No. HEI 2-265979 (filed on Oct. 3, 1990) which is expressly incorporated herein by reference in its entirety.

What is claimed is:

1. An electrophotographic printer using a plurality of types of continuous recording forms having different page lengths, respectively, perforations being provided between pages of said continuous recording forms, a toner image being transferred onto the continuous recording form at a transfer position and fixed at a fixing position, said printer being operated at least in a standby state and in a printing state, said printer comprising:

feed means for feeding said continuous recording from loaded into said printer;

control means for controlling said feed means such that the perforations of said loaded continuous recording form are located at a predetermined position when said printer is in said standby state, regardless of the page length of said continuous recording form loaded into said printer;

input means for inputting a data representing the page length of said continuous recording form loaded into said printer; and memory means for storing a plurality of sets of control data used for feeding said continuous recording form, one set of said control data corresponding to respective page-lengths of said continuous recording forms;

wherein said control means controls said printer in accordance with one set of said control data corresponding to the data inputted by said input means, such that either one of an exposure operation or a feeding operation starts prior to the other, based upon said data inputted by said input means.

2. The electrophotographic printer according to claim 1, wherein said predetermined position coincides substantially with said transfer position of said printer.

3. The electrophotographic printer according to claim 1, wherein said predetermined position coincides substantially with said fixing position of said printer.

4. An electrophotographic printer using a plurality of types of continuous recording forms having different page lengths, respectively, perforations being provided between pages of said continuous recording forms, a toner image being transferred onto the continuous recording form at a transfer position and fixed at a fixing position, said printer being operated at least in a standby state and in a printing state, said printer comprising:

feed means for feeding said continuous recording form loaded into said printer; and control means for controlling said feed means such that the perforations of said loaded continuous recording form are located at a predetermined position when said printer is in said standby state, regardless of the page length of said continuous recording form loaded into said printer, said control means controlling the printer such that either one of an exposure operation or a feeding operation starts prior to the other, based upon the page length.

5. The electrophotographic printer according to claim 4, further comprising:

input means for inputting a data representing the page length of said continuous recording form loaded into said printer; and memory means for storing a plurality of sets of control data used for feeding said continuous recording form, one set of said control data corresponding to respective page-lengths of said continuous recording forms;

wherein said control means controls said feed means in accordance with one set of said control data corresponding to the data inputted by said input means.

6. The electrophotographic printer according to claim 5, further comprising detect means for detecting a feeding amount of said continuous recording form, wherein said control means controls said feed means based on the comparison of said feeding amount with said one set of control data.

7. The electrophotographic printer according to claim 5, wherein said control data stored in said memory means comprises:

a first feeding amount of said continuous recording form required for initially bringing it into said standby state; and a second feeding amount of said continuous recording form required for feeding of said continuous recording form to bring it again in said standby state after an image-transfer operation has been completed.

8. An electrophotographic printer using a plurality of types of continuous recording forms having different page lengths, respectively, perforations being provided between pages of said continuous recording forms, a toner image being transferred onto the continuous recording form at a transfer position and fixed at a fixing position, said printer being operated at least in a standby state and in a printing state, said printer comprising:

feed means for feeding said continuous recording form loaded into said printer;

control means for controlling said feed means such that the perforations of said loaded continuous recording form are located at a predetermined position when said printer is in said standby state, regardless of the page length of said continuous recording form loaded into said printer;

input means for inputting a data representing the page length of said continuous recording form loaded into said printer;

memory means for storing a plurality of sets of control data used for feeding said continuous recording form, wherein said control data stored in said memory means comprises:

control data corresponding to respective page-lengths of said continuous recording forms;

a first feeding amount of said continuous recording form for initially bringing it into said standby state;

a time interval required between the start of an exposure operation and the start of a feeding operation of said continuous recording form;

a second feeding amount of said continuous recording form required between the start of the synchronized operations of said exposure and said feeding and the start of an image-transfer operation; and a third feeding amount of said continuous recording form required for feeding of said continuous recording form to bring it again in said standby state after said image-transfer operation has been completed;

wherein said control means controls said feed means in accordance with one set of said control data corresponding to the data inputted by said means.

9. An electrophotographic printer using a plurality of types of continuous recording forms having different page lengths, respectively, perforations being provided between pages of said continuous recording forms, a toner image being transferred onto the continuous recording form at a transfer position and fixed at a fixing position, said printer being operated at least in a standby state and in a printing state, said printer comprising:

feed means for feeding said continuous recording form loaded into said printer;

control means for controlling said feed means such that the perforations of said loaded continuous recording form are located at a predetermined position when said printer is in said standby state, regardless of the page length of said continuous recording form loaded into said printer;

memory means for storing a plurality of sets of control data used for feeding said continuous recording form, wherein said control data stored in said memory means comprises:

a time interval required between the start of an exposure operation and the start of a feeding operation of said continuous recording form; and a feeding amount of said continuous recording form required between the start of the synchronized operations of said exposure and said feeding and the start of an image-transfer operation.

10. The electrophotographic printer according to claim 9, wherein said control data stored in said memory means further comprises:

a second feeding amount of said continuous recording form for initially bringing it into said standby state; and a third feeding amount of said continuous recording form required for feeding of said continuous recording form to bring it again in said standby state after said image-transfer operation has been completed.

* * * * *

UNITED STATES PATENT AND TRADEMARK OFFICE

CERTIFICATE OF CORRECTION

PATENT NO. : 5,194,903

DATED : March 16, 1993

INVENTOR(S) : K. NEGISHI et al.

It is certified that error appears in the above-indentified patent and that said Letters Patent is hereby corrected as shown below:

At column 7, line 65 (claim 1, line 10), change "from" to ---form---.

Signed and Sealed this

Seventeenth Day of December, 1996

*Attest:*

Bruce Lehman

BRUCE LEHMAN

*Attesting Officer*

*Commissioner of Patents and Trademarks*